United States Patent [19]

Weber et al.

[11] 4,142,941

[45] Mar. 6, 1979

[54] METHOD FOR PRODUCING BLAST FURNACE COKE

[75] Inventors: Heinrich Weber, Recklinghausen; Horst Dungs, Herne; Klaus Urbye, Flaesheim; Franz Beckmann, Alsdorf; Hugo Schmauch, Merchweiler, Saar; Karl H. Flasche, Bons, Saar, all of Fed. Rep. of Germany

[73] Assignee: Firma Carl Still Recklinghausen, Fed. Rep. of Germany

[21] Appl. No.: 832,365

[22] Filed: Sep. 12, 1977

[30] Foreign Application Priority Data

Sep. 10, 1976 [DE] Fed. Rep. of Germany ..... 2640787

[51] Int. Cl.[2] ..... C10B 45/02; C10B 53/08; C10L 5/16

[52] U.S. Cl. ..... 201/6; 44/10 C; 44/10 E; 44/10 F; 44/10 H; 201/4; 201/8; 201/23

[58] Field of Search ..... 201/4, 6, 8, 23

[56] References Cited

U.S. PATENT DOCUMENTS

| | | | |
|---|---|---|---|
| 1,334,180 | 3/1920 | Smith | 201/23 X |
| 2,105,832 | 1/1938 | Becker | 201/23 X |
| 2,314,641 | 3/1943 | Wolf | 201/23 X |
| 2,556,154 | 6/1951 | Kern | 201/8 X |
| 2,838,386 | 6/1958 | Mason | 201/23 X |
| 3,010,882 | 11/1961 | Barclay et al. | 201/6 UX |
| 3,051,628 | 8/1962 | Gorin et al. | 201/23 X |
| 3,151,041 | 9/1964 | Heinze et al. | 201/6 |
| 3,444,047 | 5/1969 | Wilde | 201/23 X |
| 3,663,186 | 5/1972 | Dzhaparidze et al. | 201/6 X |

FOREIGN PATENT DOCUMENTS

| | | | |
|---|---|---|---|
| 2018374 | 10/1971 | Fed. Rep. of Germany | 201/6 |
| 2208443 | 8/1973 | Fed. Rep. of Germany | 201/6 |
| 2555431 | 6/1977 | Fed. Rep. of Germany | 201/6 |
| 291836 | 6/1928 | United Kingdom | 201/6 |
| 840043 | 7/1960 | United Kingdom | 201/6 |

*Primary Examiner*—Barry S. Richman
*Attorney, Agent, or Firm*—McGlew and Tuttle

[57] ABSTRACT

A method of producing blast furnace coke from bituminous coals, particularly coals having poor coking capacities in which the coal to be carbonized is ground, predried or preheated, mixed with binders, compressed or formed into briquets having small mechanical resistances and charged into oven chambers, is characterized by fine coals or fine coal mixtures having a swelling index in mixture according to DIN 51741, smaller than 7, and preferably, below 6, and comprising more than 50% of poorly or non-baking coal having a content of volatile matter in excess of 30% or less than 20% which coals or coal mixtures are ground up to attain asurface per unit mass, according to DIN 66145, of from 400 $cm^2$ to 1200 $cm^2$ per gram, and with from 3% to 8% by weight of organic binders, compressing the mixture to form it into a briquet at a temperature range of from 70° C. to 300° C. and charging the compressed briquet into the oven chambers without substantial intermediate cooling in order to carbonize it.

8 Claims, 1 Drawing Figure

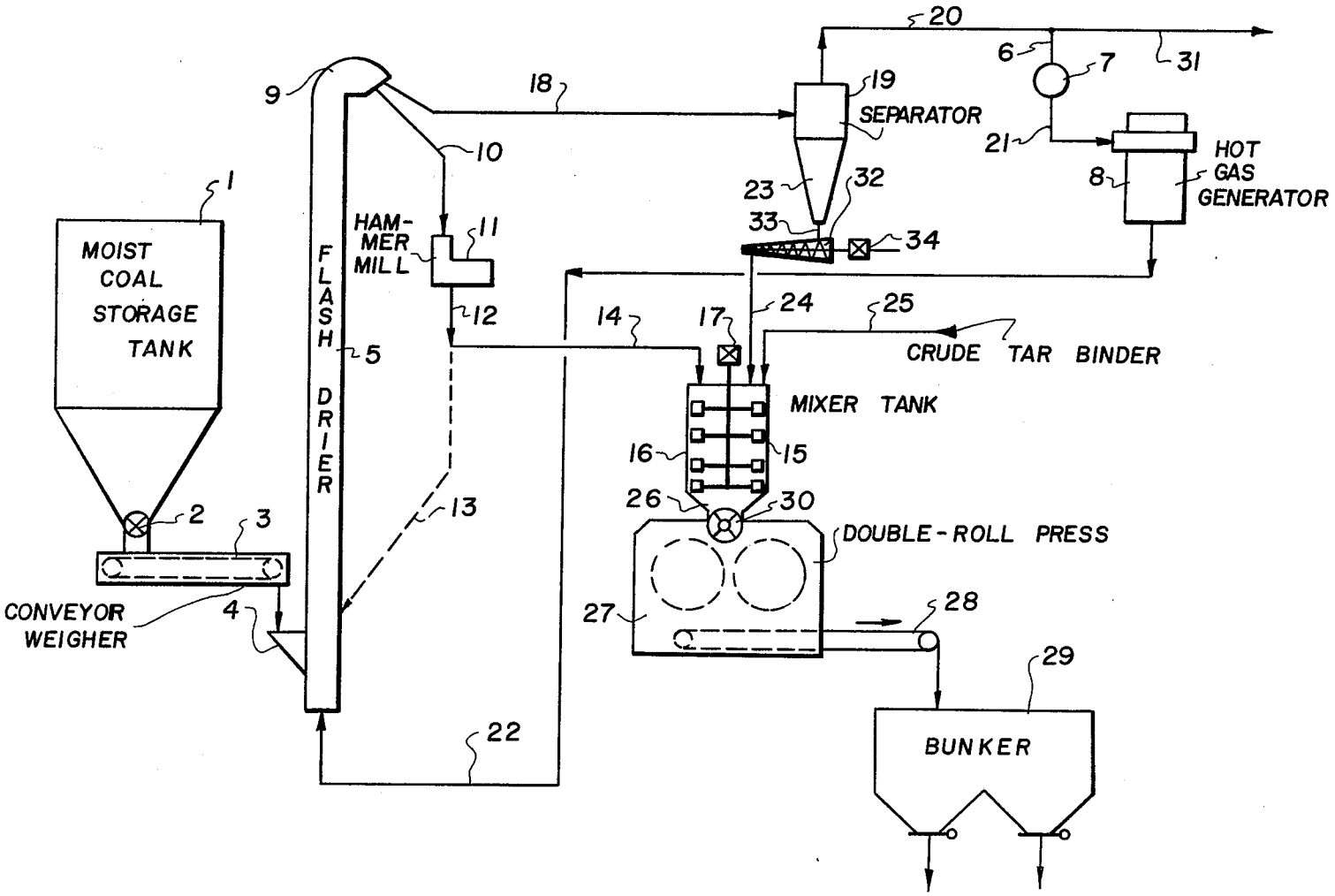
HOT GAS GENERATOR
CRUDE TAR BINDER
MIXER TANK
DOUBLE-ROLL PRESS
BUNKER
SEPARATOR
HAM-MER MILL
FLASH DRIER
MOIST COAL STORAGE TANK
CONVEYOR WEIGHER

METHOD FOR PRODUCING BLAST FURNACE COKE

FIELD AND BACKGROUND OF THE INVENTION

This invention relates in general to blast furnace fuels and, in particular, to a new and useful method of, and apparatus for producing blast furnace coke from bituminous coals, particularly coals with poor coking capacities, in which the coals to be carbonized are ground, predried or preheated, mixed with binders, compressed or formed into briquets which have a small mechanical resistance and are charged into the oven chambers.

DESCRIPTION OF THE PRIOR ART

Briquets must be able to withstand, without breaking, substantially only the transportation to the coke oven chambers, whereupon, their fragmentation during charging into the oven chambers is desirable to obtain a compact and uniform filling. Such a method is known, for example, for coal containing water, from French Patent No. 1,195,232, and it has already been applied in practice for a long time. In this method, no organic binder is used for briquetting the moist, fine coal. For predried or preheated coal, such a method has been provided in German Patent Application No. P 25 554 31.8, with the use of organic binders. Also known is the carbonization of coal cakes compressed in a stamping operation in horizontal chamber ovens, which process requires quite expensive equipment.

The methods of the prior art do not ensure a well-defined quality of coke, and the results may scatter considerably. It may happen, for example, that coke with higher resistance is obtained in the lower part of horizontal coke ovens, rather than in the upper part, and the use of different kinds of coal may result in an unequal graduation of grain sizes in the coke.

SUMMARY OF THE INVENTION

The present invention is directed, inter alia, to a generally applicable manner of an advance treating of the coal which is used by drying and preheating, and preparing, as well as compressing, a binder containing briquetted material which is suitable for carbonizing a variety of grades of coal having a poor coking capacity. The invention is further directed to a device for carrying out such a method.

Since only predried coals are used, an admixture of binders of organic nature is inevitable and this, as well as the briquetting and compression, leads to various, partly economic and partly technological, problems. One of these problems is, for example, the selection of the binder which must not be chosen so as to result in an economic burden for the entire coking operation.

A technological problem, for example, is the determination of the amount of binder to be added, while taking into account that the mechanical resistance of the briquets is to be relatively low. Another criterion is that the coating of the coal particles must be so complete as to obtain an effective adhesion power of the binder and to prevent dust from being carried over into the collecting main, particularly during the oven chamber filling operation and also during the carbonization.

Care must also be taken, in order to obtain a correct binder dosing, that a bonding with the coal substance is obtained at 200° C. to 300° C., particularly with aromatic binders. At these temperatures, with the coal particles completely covered, non-bonded material would flow downwardly in excess, accumulate in the lower parts of the oven chambers, and perhaps leak from the chambers to the outside.

The degree of grinding is also of importance. In the methods of the prior art, 85% to 95% of the coal particles are to be sized up to 3mm, and the coarseness of the balance must not exceed 10 mm. The possibility of a relation, in connection with the carbonization, between the specific surface and the quantity of the added binder has not yet been known.

In order to solve the above-noted problems, the invention provides that the coals to be used for coking, having a swelling index in mixture, according to DIN 51741, smaller than 7, preferably below 6, and containing more than 50% of poorly or non-baking coals with more than 30% and less than 20% of volatile matter, are ground up to attain a surface per unit mass $O_m$, according to DIN 66145, of from 400 $cm^2$ to 1200 $cm^2$ per gram, and mixed with 3% to 8% by weight of organic binders, and that this mixture is compressed or briquetted in double-roll presses at 70° C. to 300° C. and filled, with or without a substantial intermediate cooling, into the oven chambers, for carbonization.

It is preferable to add the binder in an amount of 3% to 6% by weight with a surface per unit mass of 400 $cm^2$ to 1000 $cm^2$ per gram, and with a surface per unit mass of 600 $cm^2$ to 1200 $cm^2$ per gram, the preferable addition of binder is 5% to 8% by weight.

As compared to this, in the conventional chamber coking processes of the prior art, fine coal is used having its optimum graduation of size as follows:

3.15–2.00 mm; 16.1% by weight.
2.00–1.00 mm; 24.9% by weight.
1.00–0.50 mm; 24.9% by weight.
smaller than 0.50 mm; 34.1% by weight.

For these values, the surface per unit mass $O_m$, according to DIN 66145, is equal to 275 $cm^2$ per gram (Simonis-Rubrecht: "Optimum granulometric structure of coking coal", periodical Gluckauf-Forschung No. 6, 1965, pages 301 to 308). In general, thus also in the Ruhr district of West Germany, the surfaces per unit mass for top-charging operations do not reach this optimum, and amount only to about 230 $cm^2$ per gram.

In accordance with the invention, coals having a substantially larger surface per unit mass are used for coke production.

Although it is known for the production of bituminous coal briquets to use coals having surfaces per unit mass of 300 $cm^2$ to 700 $cm^2$ per gram, and to mix and press them with 5% to 8% by weight of organic binders, this is done for the purpose of producing briquets which, after cooling, are hard, strong and suitable as domestic fuel, but not for the production of coke. The inventive method departs from these methods of the prior art insofar as the cooling has been omitted intentionally. In the inventive method, the temperature at which the compression or briquetting is carried out is also advantageously adjusted to the fusing temperature of the binder.

For a fusing temperature (Ep after Kremer-Sarnow) of 30° C. to 80° C., a compression temperature of 60° C. to 200° C. is provided, and for an Ep of 80° C. to 160° C., the compression temperature provided is 140° C. to 300° C.

Particularly advantageous is the use of crude tar, of the own or another plant as binder, not only because of its low price, but also in view of its simple handling. The crude tar used may be hydrous or anhydrous. Since it has a low Ep of 30° C. and less, a compression temperature of less than 100° C. is advisable. In this connection, it is to be noted that the use of crude tar as the binder to produce hard, resistant, briquets, employed as domestic fuel, is out of the question.

The inventive pretreatment of the coals used may be limited to a proportion of 80%, with the balance, namely, up to 20%, either remaining without any pretreatment or being only predried or preheated, with or without a binder and, in any case, without compression, and charged into the oven chamber.

It is also possible with the inventive method to provide further simplification relative to the prior art. Precompression of the mixture prior to the briquetting operation is not necessary.

The amount of pressure to be applied to form the briquets does not exceed the usual values, so that ordinary double-roll presses of a conventional design may be employed. In any event, it is not absolutely necessary to form briquets. Double-roll presses with grooved rolls or even simple presses with two smooth rolls may be used to merely compress the coal-binder mixture therebetween.

Experience has also shown that the mechanical resistance of the briquets thus obtained is satisfactory to the extent that the bulk of the briquets endures the transportation into the hopper of the charging car without breaking and is fragmented in the desired manner only upon falling into the oven chamber, thereby, partly forming smaller fragments which remain compressed and combine with the unbroken portion to produce a uniform oven chamber filling. The bulk density thus obtained in the oven chambers amounts to 780 to 900 kg per metric ton. With this bulk weight and added binder, metallurgical coke of good quality is obtained.

The use of flash driers is advantageous since they perform grinding work and, for example, if fine coals having grain diameters of up to 10 mm are treated, it is only necessary to remove the coarse grain from the drier current, which grain amounts to a proportion of approximately 25%, and to subject it to further grinding. In this way, grinding equipment of smaller size can be provided and the power requirement is correspondingly lower.

In order to mix several sorts of coal to a briquetting mixture or also for mixing a single sort of fine coal with the binder, the vertical mixing tank described in German Offenlegungsschrift No. 2.208.443.1 has proven to be particularly suitable, especially for high performances. This mixing tank comprises n vertical cylinders, n being a number of two to four, which are of identical design and partly overlap each other and in which stirrers or rabbles are mounted in a manner such that their ranges of action intersect. The tank is tapered toward the outlet in its lower end portion and above the inlet openings, m (n − 1) dosing devices at most, for m mixing components, are provided in the effective zone of intersection of the stirrers or rabbles.

It has further proven to be advantageous to abstain from storing the coal dried and preheated in the drier, or from storing substantial amounts thereof in an intermediate bunker, and to convey it instantly, through a conduit and an interconnected separator, into the mixing tank. On the other hand, such an arrangement requires the provision of dosing and weighing of the coal ahead of the drier, with the coal in its moist state. This is an advantage, however, since unlike dry coal, moist coal can be dosed and weighed without development of dust.

This results in a rugged, nearly trouble-proof apparatus for dosing, drying and heating, mixing of the coal with binders, and compressing of the mixture to briquets, which does not require any storage or intermediate tanks for the heated and dried material to be compressed, nor does it require an inert gas scavenging or covering, which substantially contributes to the simplification of the device.

Accordingly, it is an object of the invention to provide an improved method of producing blast furnace coke from bituminous coals, which comprises, mixing fine coals or fine coal mixtures which have swelling indexes in a mixture smaller than 7 and comprising more than 50% of poorly or non-baking coal having a content of volatile matter in excess of 30% or less than 20% and which coals or coal mixtures are ground up to attain a surface per unit mass of from 400 $cm^2$ to 1200 $cm^2$ per gram with from 3% to 8% by weight of organic binders, compressing the mixture to form it into a briquet at a temperature range of from 70° C. to 300° C. and charging the compressed briquet into the oven chambers without substantial intermediate cooling to carbonize it.

A further object of the invention is to provide a device for carrying out the method which includes coal-dosing equipment, coal drying apparatus, mixers for mixing the coal with the organic binders, and a double-roll press and wherein the dosing equipment for the fine coal is provided ahead of the drier and a mixer is provided for mixing the fine coal with binders, which is interposed between a separator immediately following the drier and a double-roll press immediately following the mixer.

Another object of the invention is to provide a device for producing blast furnace coke which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference should be had to the accompanying drawing and descriptive matter in which there is illustrated a preferred embodiment of the invention.

BRIEF DESCRIPTION OF THE DRAWING

In the Drawing:

The only FIGURE of the drawing is a schematic representation of a device for producing blast furnace coke, constructed in accordance with the invention.

DESCRIPTION OF THE PREFERRED EMBODIMENT

Referring to the drawing in particular, the invention embodied therein, comprises a system for producing blast furnace coke from bituminous coals. The drawing shows a storage tank 1 for the moist coal, having a cellular outlet lock 2 at its tapered lower end portion. The coal having a grain ranging up to 10 mm in diameter is discharged through the lock onto a conveyor-type weigher 3, wherefrom, the coal passes into the inlet lock 4 of a flash drier 5. Flash drier 5 receives a hot gas current through a line 22. This may be a current of waste heat gases of a neighboring combustion equipment. In the present example, the current is delivered by a hot gas generator 8. The hot gas current having a temperature of from 400° to 700° C. conveys the fine coal to the flash drier upwardly, thereby drying, heating, and reducing the size of the coal grains. At the upper end of flash drier 5, a sifter 9 is provided in which the coarse grain is separated for delivery through a downpipe 10 to a hammer mill 11. Here, the coarse grain is further ground and discharged through a line 12. This ground portion is either recycled through a line 13, to the lower part of flash drier 5, or it is furnished directly to a vertical mixing tank 16 equipped with rabble arms 15 and a drive 17.

The bulk of the coal stream from sifter 9 passes through a line 18 to a separator 19 wherefrom a great part of the dust-free gases is recycled through lines 20 and 6, a blower 7, and line 21 to hot gas generator 8, to be directed again, along with fresh hot gases and through line 22, into flash drier 5. The water absorbed by the drying gas is evacuated, along with gas in excess, through a line 31 into the free atmosphere. The fine coal portion separated in separator 19 and accumulated in the lower part 23 thereof and having a temperature which is still from about 70° C. to 100° C. is delivered, through a line 33, a conical worm 32 having a drive 34 and serving as a gas sealing, and a line 24, to the mixing tank 16.

In mixing tank 16, the coal is mixed with crude tar having a temperature of 70° C. and furnished through a line 25 and the mixture is directed through a feeder 30 provided at the conical end portion 26 of the tank into a double-roll press 27. The finished briquets still have a temperature of about 60° C. to 90° C. and they are transferred, without cooling and without substantial fragmentation, by a conveyor belt 28 to a bunker structure 29 wherefrom they are discharged, again without substantial fragmentation, into the hoppers of the coke oven battery charging car, to be charged into the oven chambers. During this charging, a part of the briquets breaks into fragments of compressed fine coal in which the unbroken briquets or large briquet parts become embedded, thereby, producing a homogeneous oven chamber filling.

The invention provides a method of producing blast furnace coke from bituminous coals and particularly coals having poor coking capacities in which the coal to be carbonized is ground, predried and preheated, mixed with binders, compressed or formed into briquets having a small mechanical resistance and charged into coke oven chambers.

The inventive method is characterized by the fact that fine coals or fine coal mixtures are used which have a swelling index in according accordng to DIN 51741 smaller than 7, and preferably below 6, such coals comprise more than 50% of poorly or non-baking coal having a content of volatile matter in excess of 30% or less than 20%. The coal or coal mixtures are ground up to attain a surface per unit mass, according to DIN 66145, of from 400 $cm^2$ to 1200 $cm^2$ per gram. These fine coals are mixed with from 3% to 8% by weight of organic binders. The mixture is compressed or formed into briquets at temperatures of from 70° C. to 300° C. in double-roll presses, such as the press 27. The briquets are then charged directly into the oven chambers without substantial intermediate cooling and they are carbonized in such oven chambers, which have not been shown in the drawing.

While a specific embodiment of the invention has been shown and described in detail to illustrate the application of the principles of the invention, it will be understood that the invention may be embodied otherwise without departing from such principles.

What is claimed is:

1. A method of producing blast furnace coke from bituminous coals, particularly coals having poor coking capacities, comprising mixing fine coals or fine coal mixtures which have a swelling index smaller than 7 (according to DIN 51741) and which comprise more than 50% of poorly or non-baking coal having a content of volatile matter in excess of 30% or less than 20%, grinding the coals or coal mixtures to attain a surface per unit mass of from 400 $cm^2$ to 1200 $cm^2$ per gram (according to DIN 66145), mixing the ground coals with from 3% to 8% by weight of a hydrous or anhydrous crude tar binder to form a coal and binder mixture, compressing the coal and organic binder mixture to form it into briquettes at a temperature range of from 70° C. to below 100° C., and charging the briquets into oven chambers, without substantial intermediate cooling, so as to carbonize the coal into blast furnace coke.

2. A method according to claim 1, wherein the binder is added in an amount of from 3% to 6% by weight and the coal is ground to a surface per unit mass of from 400 $cm^2$ to 1000 $cm^2$ per gram.

3. A method according to claim 1, wherein the binder is added in an amount of from 5% to 8% by weight with a surface per unit mass $O_m$ of from 600 $cm^2$ to 1200 $cm^2$ per gram.

4. A method according to claim 1, wherein the binder has a fusing temperature of from 30° C. to 80° C.

5. A method according to claim 1, wherein the binder has a fusing temperature of from 80° C. to 160° C.

6. A method according to claim 1, wherein up to 20% of the ground coal is charged into the oven chambers without being compressed or briquetted.

7. A method according to claim 1, including directing flue gases over the fine coals as an inert gas current.

8. A method according to claim 1, wherein the coal is dried and conveyed directly without intermediate treatment into a mixer for mixing with the binders.

* * * * *